United States Patent [19]

Gable et al.

[11] 4,386,639

[45] Jun. 7, 1983

[54] OIL DRAINAGE APPARATUS

[75] Inventors: Derek J. Gable, Rancho Palos Verdes; Roger H. Sweet, Long Beach; Nicol S. Wilson, Redondo Beach, all of Calif.

[73] Assignee: Sta-Lube, Inc., Compton, Calif.

[21] Appl. No.: 293,505

[22] Filed: Aug. 17, 1981

[51] Int. Cl.[3] ..... B65B 3/04

[52] U.S. Cl. ..... 141/351; 141/326; 184/1.5; 251/149.6; 285/DIG. 15

[58] Field of Search ..... 141/346-362, 141/200, 207, 218-226, 382-386, 325, 326, 327; 184/1.5; 251/149.5, 149.6; 285/DIG. 15, 401, 376, 360

[56] References Cited

U.S. PATENT DOCUMENTS

| | | | |
|---|---|---|---|
| 2,265,267 | 12/1941 | Cowles et al. | 251/149.6 |
| 3,295,564 | 1/1967 | Kibler et al. | 141/354 |
| 3,631,904 | 1/1972 | Mason et al. | 141/351 |
| 4,123,089 | 10/1978 | Viero et al. | 285/DIG. 15 |
| 4,272,019 | 6/1981 | Halaby | 141/351 |

FOREIGN PATENT DOCUMENTS

| | | | |
|---|---|---|---|
| 6216 | of 1909 | United Kingdom | 251/149.6 |
| 2069083 | 8/1981 | United Kingdom | 251/149.6 |

*Primary Examiner*—Houston S. Bell, Jr.
*Attorney, Agent, or Firm*—Ralph B. Pastoriza

[57] ABSTRACT

A normally closed drain valve is substituted for the normal drain plug in a conventional automobile crank case. Rather than remove the normally provided drain plug each time the oil is to be drained, it is only necessary to open the drain valve. Opening of this valve is accomplished by a specially designed coupler connected to a plastic bag. The arrangement is such that when the coupler is urged over the drain valve and twisted, the valve automatically opens to fill the bag with oil. The coupler can then be twisted back to its original position to close the drain valve and removed with the bag containing the oil. The entire operation can be accomplished only using one hand and with substantially no risk of oil spilling or soiling the operator.

8 Claims, 9 Drawing Figures

OIL DRAINAGE APPARATUS

FIELD OF THE INVENTION

This invention relates generally to the draining of a liquid or powder from a receptacle and more particularly, to an improved apparatus for facilitating this operation. The initial application of this invention is the withdrawing of oil from engine casings.

BACKGROUND OF THE INVENTION

Normally, an automobile crank case is provided with a drain plug on its underside. When it becomes necessary to change the oil, a garage mechanic will simply remove the oil plug from underneath the crank case and permit the oil to drain into a funnel or similar structure or sometimes simply let it spill on the garage floor. After drainage is complete, the garage mechanic will then replace the drain plug and new oil is then poured into the crank case.

The foregoing operation is time consuming and messy. As a consequence, there have been a number of proposals for facilitating the draining of oil from an engine crank case.

One such proposal involves placing a wrench socket within a funnel so that when the drain plug is unthreaded, the funnel is in proper position to catch oil as it drains from the crank case. In other instances, an actual valve has been designed and proposed for substitution for the normal drain plug so that rather than remove the drain plug, it is only necessary for an operator to open the valve. In this latter arrangement, it is still necessary to provide a funnel or some other means properly disposed to catch the oil after the valve has been opened.

Thus, while the above proposed substitution of a drain valve for a drain plug will eliminate the necessity for tools provided that the valve can be manually opened and closed, there still exists the problem of oil spillage and soiling of the operator's hands in operating the valve.

BRIEF DESCRIPTION OF THE PRESENT INVENTION

With the foregoing considerations in mind, the present invention contemplates a vastly improved oil drainage apparatus wherein the draining of oil can be accomplished without special tools and in substantially shorter time than has been possible heretofore. Moreover, the present invention provides an apparatus which substantially eliminates any possibility of oil spillage or an operator soiling his hands.

More particularly, in accord with the present invention there is provided a normally closed drain valve for substitution for the normal drain plug in the engine casing. This drain valve has exposed means for opening the same. A cooperating coupler defining an end opening for engagement over the drain valve is provided. This coupler includes internal means for engaging the exposed means and thereby opening the valve, only after the coupler is in fully surrounding relationship with the valve. A flexible bag such as a plastic bag is provided in sealing communication with the coupler and its end opening for collecting oil after the coupling is positioned to open the drain valve.

In the preferred embodiment, the coupler is designed such that it is essentially locked to the drain valve only when the drain valve is opened and releasable from the drain valve only after the drain valve has been closed. As a consequence, there is substantially no risk of oil spillage or soiling of the user's hands.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
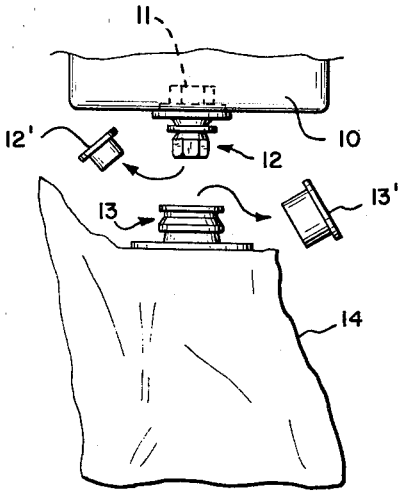
FIG. 1 is an elevational view of the basic components making up the oil drainage apparatus of this invention preparatory to draining oil from a crank case.
Figure 2:
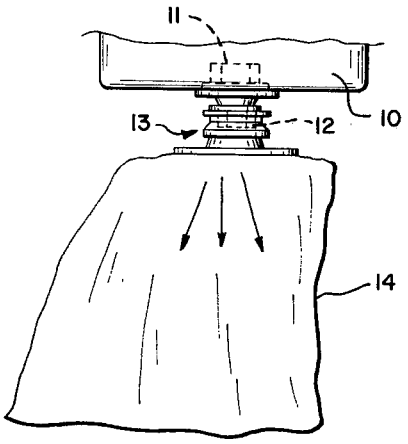
FIG. 2 shows the components of FIG. 1 in operative relationship for draining oil from the crank case.

Referring first to FIGS. 1 and 2, there is schematically illustrated the manner in which the basic components of the present invention facilitate draining of oil from a crank case. In FIG. 1, the lower portion of the crank case is shown at 10. This crank case would include a normal drain plug on its underside received with internal threads 11. However, in accord with the present invention, a normally closed drain valve 12 is substituted for the conventional drain plug, this valve 12 being received within the threaded portion 11.

A coupler 13 has an upper open end sealingly connected to and in communication with a collection bag 14.

Also shown in FIG. 1 are plastic cover caps 12' and 13' which are normally used to cover the drain valve 12 and coupler 13 to keep out dirt and dust when these components are not being used. These plastic caps or covers are simply manually removed when oil drainage is to take place.

As will become clear as the description proceeds, the drain valve 12 and coupler 13 are designed to coact such that when the coupler 13 is positioned over the drain valve as illustrated in FIG. 2 and urged upwardly and twisted, it will lock to the drain valve and open this drain valve so that oil will flow directly into the bag 14 by way of the coupler 13. This operation can be carried out by one hand of the operator.

After the oil has drained from the crank case 10, the coupler 13 is rotated in an opposite direction and simply removed from the valve 12, this action automatically resulting in the valve 12 closing. Fresh oil can then be placed in the crank case.

The manner in which the foregoing is accomplished will now become evident by referring to the detailed showings of the drain valve and coupler in FIGS. 3 through 9.

Figure 3:
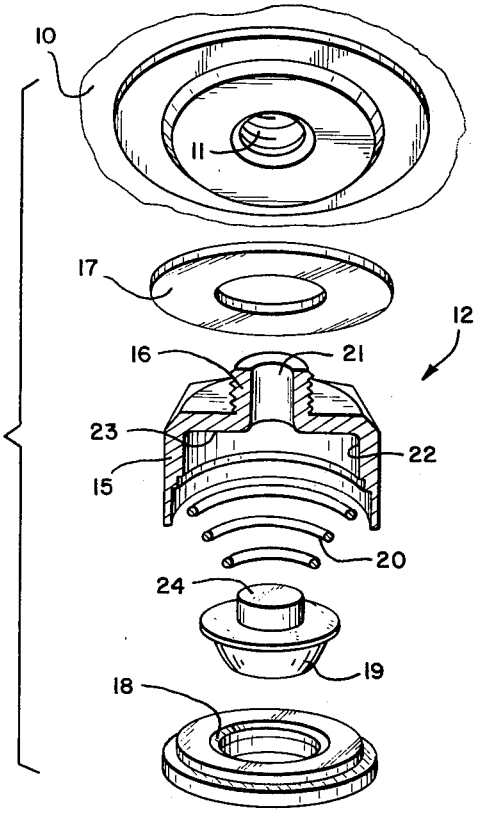
FIG. 3 is an exploded perspective view of the drain valve portion of the apparatus of FIG. 1.

Referring first to FIG. 3, there is illustrated at the top in fragmentary perspective view the underside of the crank case 10 and the threaded opening 11 which normally receives the drain plug.

The drain valve 12 in accord with the present invention includes a main body 15 having an exteriorally threaded neck 16 receivable in the threads 11. A washer 17 is provided as part of the assembly, the purpose for which will become clearer as the description proceeds.

Shown in the lower portion of FIG. 3 is a spherical valve seat 18 within the main body 15. A valve head 19 having a mating spherical surface in turn, is held on the seat 18 by an appropriate spiral compression spring 20.

It will be noted that the threaded neck 16 of the drain valve has an interior passage 21 which communicates with an interior chamber 22 within the main body 15 of substantially larger diameter thereby defining an upper annular shoulder 23. This shoulder serves to seat the upper end of the spiral spring 20. The lower end of the spring, in turn, is indexed in axial alignment with the valve seat 19 by a concentric projection 24.

Figure 4:
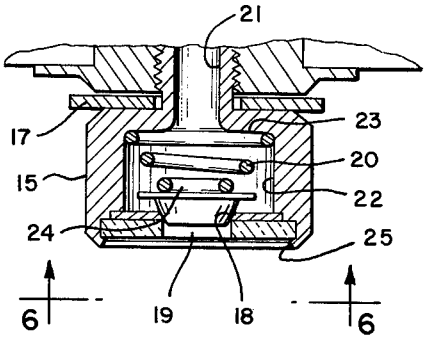
FIG. 4 is a cross-sectional view of the components of the drain valve in assembled relationship in its normally closed position.

The various components described in FIG. 3 in assembled relationship are clearly shown in FIG. 4 wherein it will be noted that the spring 20 is holding the valve head 19 on the seat 18 so that the valve is normally closed and oil is retained within the crank case the same as though a drain plug were used.

Figure 5:
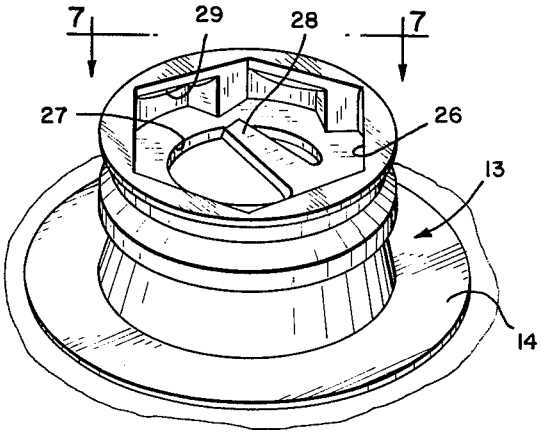
FIG. 5 is a fragmentary perspective view of the coupling component and associated collector bag for cooperation with the drain valve of FIG. 4.

FIG. 5 illustrates in perspective view the coupler 13 described briefly in FIGS. 1 and 2. As shown, this coupler has an upper open end 26 dimensioned to receive the main body 15. The lower portion of the coupler 13 has an outlet opening 27 communicating with the bag 14. This opening includes an integral radially inwardly and upardly extending arm 28 positioned to engage the underside of the valve seat 19 when the coupler 13 is telescopically moved over the main body 15.

In the particular embodiment illustrated in FIGS. 4 and 5, the exterior of the main body 15 is hexagonal in shape while the upper open end 26 in turn has an hexagonal periphery. This periphery has undercut portions as indicated at 29 thereby permitting rotation of the coupler about the main body 15 after the coupler has been telescopically urged beyond the end of the main body as illustrated in FIG. 2. The coupler is thus longitudinally locked after rotation to the body to hold the same while oil is draining through the valve. In this respect, when in the completed telescoped position, the integral arm 28 will have engaged and lifted the valve head 19 from the valve seat 18.

All of the foregoing will be more clearly understood by now referring to FIGS. 6 through 9.

Figure 6:
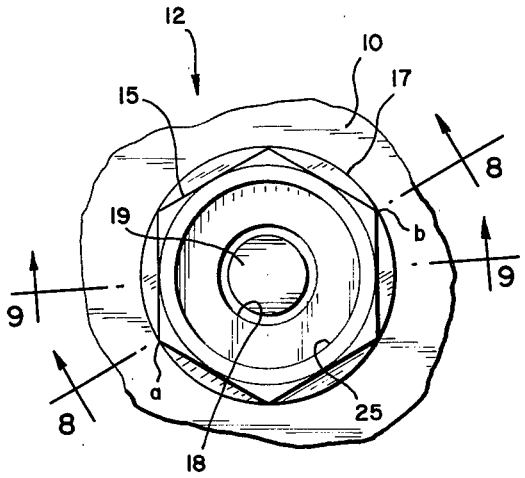
FIG. 6 is a plan view of the drain valve taken in the direction of the arrows 6—6 of FIG. 4.
Figure 7:
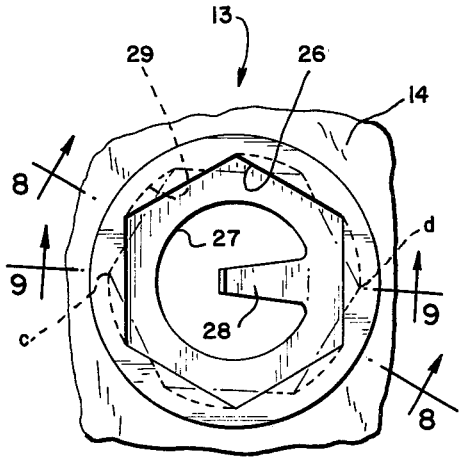
FIG. 7 is a plan view of the coupler taken in the direction of the arrow 7—7 of FIG. 5.

FIGS. 6 and 7 respectively show in plan views the hexagonal shapes of the main body 15 and the periphery 26 of the coupler 13 as described. In FIG. 7, it will be noted that the undercut portions of the periphery of the upper open end 26 are assymmetrical. This assymmetrical undercutting will permit rotation of the main body 15 when fully telescoped within the coupler in only one direction and through only a limited number of degrees. In the embodiment illustrated, the rotation only takes place through 35°.

FIGS. 6 and 7 include cross-section lines and arrows designated 8—8 and 9—9. The following FIGS. 8 and 9 illustrate the drain valve and the coupler respectively in these cross-sectional views.

Figure 8:
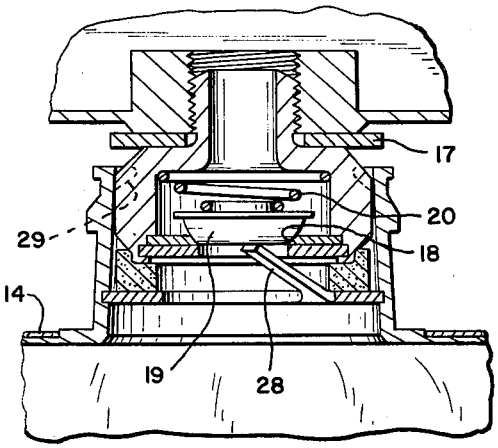
FIG. 8 is a fragmentary cross section of the drain valve and coupler showing the coupler in an initially set position preparatory to opening the drain valve; and, FIG. 9 is a view similar to FIG. 8 illustrating the coupler and drain valve in fully coupling relationship and in rotated positions to effect a draining of the oil from the crank case.

Considering first FIG. 8, the coupler is shown in its initially telescoped relationship with the main body wherein the hexagonal surfaces of the main body are received within the hexagonal periphery of the upper open end 26. In the relative positions illustrated in FIG. 8, it will be noted that the integral arm 28 barely makes contact with the underside of the valve seat 19.

Figure 9:
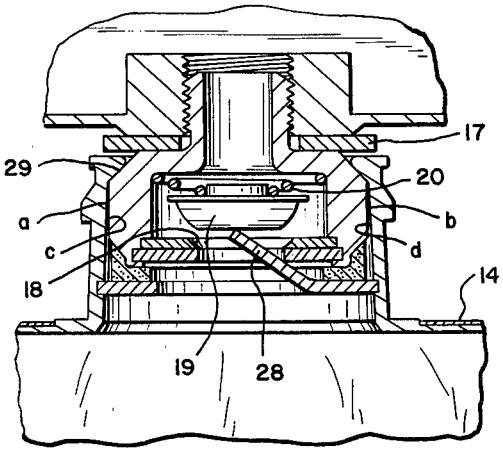

Referring now to FIG. 9, the coupler has been urged into complete telescoped relationship wherein the top portion of the coupler engages the underside of the washer 17. In this position, the undercut portions overlap the upper ends of the hexagonal surfaces in such a manner that the coupler is free to rotate through a limited distance as a consequence of the undercut portions accommodating the hexagonal surfaces of the main body.

In FIG. 9, the cover has been shown rotated through 35° which, with reference to FIG. 7, is from the section line 8—8 to the section line 9—9. The rotation takes place in a clockwise direction when the coupler is viewed from the underside or a counterclockwise direction when viewed from the top side as in FIG. 7.

The cross section of the drain valve in turn is shown in FIG. 9 as it would appear along the section lines 9—9 of FIG. 6. Note that the apexes of the hexagonal shape designated a and b in FIG. 6 are correspondingly rotated at the positions a and b in FIG. 9. Similarly, the apex points c and d of the hexagonal periphery of the upper open end 26 of the coupler shown in FIG. 7 are designated by the same letters c and d in FIG. 9.

From all of the foregoing it will be evident that the coupler is longitudinally locked to the main body of the drain valve after the coupler has been fully telescoped over the valve and rotated through 35° in a clockwise direction when looking upwardly. Also, from FIG. 9 it will be clear that the valve head 19 has been lifted from the valve seat so that communication is provided through the neck and main body portion of the drain valve and the lower opening of the coupler to the bag 14.

The spiral compression spring 20 for the valve head will, at all times, be exerting a downward force on the valve head tending to seat the same. This force is transmitted through the integral arm 28 on the coupler tending to move the coupler longitudinally downwardly. Such downward longitudinal motion is prevented by the interlocking relationship between the coupler and the main body as illustrated in FIG. 9. However, after the coupler has been rotated in a counterclockwise direction to bring it back to the position illustrated in FIG. 8, then it will be urged downwardly and free of the drain valve by the spring 20. The spherical mating surfaces of the valve seat and head assure that proper sealing will obtain even if the valve head is slightly canted.

It will further be evident from the foregoing description that the drain valve cannot be opened until the coupler fully surrounds the valve and is telescoped upwardly to its full seated position against the washer. In this respect, the washer is provided to provide a proper spacing and seating surface to thereby check the upward vertical movement of the coupler to a proper position wherein the same can then be rotated to lock it to the drain valve. Since the valve will not open until the coupler fully surrounds the valve, oil spillage and soiling of an operator's hands are substantially eliminated. Moreover, the operator can connect and disconnect the coupler to the drain valve with one hand by simply urging the same upwardly and twisting it in a clockwise direction to open the valve and after drainage is complete with his one hand twisting in a counterclockwise direction to remove the coupler and bag. This latter action will result in the valve automatically seating all as described.

It will now be evident that the present invention has provided a greatly improved oil drainage apparatus wherein no structural modifications whatever need be made on the crank case or engine casing for the oil since the drain valve is designed to merely be substituted for the normally present drain plug. Moreover, and as stated heretofore, the draining of oil can be accomplished without the necessity of any tools and wherein risk of spillage and soiling of the operator's hands is substantially reduced.

While the exterior of the main body for the drain plug has been described as hexagonal merely so that the same can be initially threaded into place by conventional wrenches, it should be understood that the structure will operate equally as well with any non-circular shaped exterior and a corresponding non-circular shaped periphery for the coupler.

Other such structural modifications can be effected without departing from the scope and spirit of this invention. The oil drainage apparatus accordingly is not to be thought of as limited to the exact embodiment disclosed merely for illustrative purposes.

Further, the use of the invention for draining oil is only a preferred initial application as noted heretofore. The apparatus can be used for draining any liquid or even powder (generically hereafter referred to as a "fluid") from a receptacle.

We claim:

1. An apparatus for facilitating the draining of oil from the crank case of an automobile including, in combination:

(a) a normally closed drain valve for said crank case, said drain valve having exposed means for opening the same;

(b) a coupler defining an end opening for engagement over the drain valve, said coupler having internal means for engaging said exposed means and opening said valve only after the coupler is axially moved into fully surrounding relationship with the valve such that said end opening extends beyond said exposed means; and (c) a bag in sealing communication with said coupler and its end opening for collecting oil after the coupler is positioned to open said drain valve.

2. An apparatus according to claim 1, including, interlocking means on said drain valve and coupler for holding the coupler onto said drain valve after it has been positioned to open the valve.

3. An apparatus according to claim 2, in which said means comprises a non-circular exterior for said drain valve and a correspondingly shaped non-circular periphery for said end opening, said periphery being undercut so that once the drain valve is wholly received in said end opening with its non-circular portion beyond the periphery of the end opening, the coupler can be rotated so that the drain body cannot be removed from the coupler until the coupler is rotated back to its initial position.

4. An apparatus for facilitating draining oil from the crank case of an automobile having a conventional threaded drain plug, including, in combination:

(a) a normally closed drain valve comprised of a main body incorporating a valve seat, valve head and compression spring for holding said valve head on said seat, and an integrally formed exteriorally threaded neck for substitution for said drain plug in said crank case;

(b) a drain valve coupler having an upper open end for receiving said main body and including an internal arm positioned to be received into the underside of said valve seat and automatically lift off said valve head to open said drain valve in response to urging of said upper open end into further telescoped relationship with said main body to a position in which said upper open end extends beyond said valve head; and (c) a bag secured to and communicating with said upper open end for receiving and containing oil passing through said drain valve when actuated to open position by said coupler.

5. An apparatus according to claim 4, in which said main body has a hexagonal exterior shape, the periphery defining said upper open end of said coupler being hexagonal to match the hexagonal shape of said main body and including undercut portions to permit rotation of the coupler about the main body after the coupler has been telescopically urged beyond the end of the main body so that the coupler is longitudinally locked to the body after rotation to hold the same while oil is draining through said valve, the spring for said valve head exerting a biasing force through the valve head on said arm tending to urge the coupler away from the main body of the drain valve so that when the coupler is rotated back to its initial position, it is automatically urged off the main body by said spring.

6. An apparatus according to claim 5, including a spacing and seating washer surrounding the neck of said drain valve and of a thickness such as to seat the upper periphery of said upper open end of the coupler in a proper position so that upon rotation, the hexagonally shaped periphery will clear the upper ends of the hexagonally shaped body, the undercut portions of said opening being assymmetrical so that the coupler can only be rotated in one direction to lock the same.

7. An apparatus according to claim 6, including plastic caps for engagement over the main body of said drain plug and the upper open end of said coupler respectively to protect the same from dirt and dust when not in use.

8. An apparatus according to claim 4, in which said valve seat is spherical and said valve head has a mating spherical surface so that proper sealing will obtain even if the valve head is slightly canted.

* * * * *